US009714819B1

(12) United States Patent
DeMeester et al.

(10) Patent No.: US 9,714,819 B1
(45) Date of Patent: Jul. 25, 2017

(54) STEPPED SABOTS FOR PROJECTILES

(71) Applicant: The Boeing Company, Chicago, IL (US)

(72) Inventors: Craig R. DeMeester, St. Louis, MO (US); Keith G. Rackers, Florissant, MO (US)

(73) Assignee: The Boeing Company, Chicago, IL (US)

( * ) Notice: Subject to any disclaimer, the term of this patent is extended or adjusted under 35 U.S.C. 154(b) by 7 days.

(21) Appl. No.: 14/061,347

(22) Filed: Oct. 23, 2013

Related U.S. Application Data

(60) Provisional application No. 61/846,482, filed on Jul. 15, 2013.

(51) Int. Cl.
*F42B 14/06* (2006.01)

(52) U.S. Cl.
CPC ..... *F42B 14/06* (2013.01)

(58) Field of Classification Search
CPC ..... F42B 14/06; F42B 14/061; F42B 14/062; F42B 14/064; F42B 14/065; F42B 14/067; F42B 14/068; F42B 14/08
USPC ..... 102/520, 521, 522, 523
See application file for complete search history.

(56) References Cited

U.S. PATENT DOCUMENTS

| | | | | | |
|---|---|---|---|---|---|
| 1,746,397 | A * | 2/1930 | Johnson | 102/439 | |
| 2,389,846 | A * | 11/1945 | Ericson | 102/523 | |
| 2,423,453 | A * | 7/1947 | Howe | F42B 14/08 102/374 | |
| 2,983,225 | A * | 5/1961 | Walker | 102/523 | |
| 2,996,992 | A * | 8/1961 | Critchfield et al. | 102/523 | |
| 3,745,926 | A * | 7/1973 | Mertz et al. | 102/523 | |
| 3,859,922 | A * | 1/1975 | Kaplan et al. | 102/521 | |
| 4,043,269 | A * | 8/1977 | Ambrosini | 102/513 | |
| 4,058,925 | A * | 11/1977 | Linde et al. | 42/79 | |
| 4,187,783 | A * | 2/1980 | Campoli et al. | 102/520 | |
| 4,505,204 | A * | 3/1985 | Wikstrom | 102/523 | |
| 4,773,331 | A * | 9/1988 | Rossman | 102/520 | |
| 5,103,736 | A * | 4/1992 | Sowash | 102/523 | |
| 5,204,494 | A | 4/1993 | Meyer et al. | | |
| 5,404,816 | A * | 4/1995 | Burri | 102/523 | |
| 5,589,658 | A * | 12/1996 | Sauvestre | 102/521 | |
| 5,773,751 | A * | 6/1998 | Fredriksson et al. | 102/473 | |
| 6,502,516 | B1 | 1/2003 | Kinchin | | |
| 7,594,472 | B1 * | 9/2009 | Parratt et al. | 102/520 | |
| 2013/0000506 | A1 | 1/2013 | Minnicino, II | | |

OTHER PUBLICATIONS

Dewar, Patrick, "The D2 Hypervelocity Projectile Program", Martin Marietta Astro Space, King of Prussia, Pennsylvania, IEEE Transactions on Magnetics, vol. 31, No. I, Jan. 1995.

McGaughey, David, et al, "Design, Development, and Testing of a Lightweight, Composite Sabot for the D-2 Program", IEEE Transactions on Magnetics, vol. 29, No. 1, Jan. 1993.

* cited by examiner

*Primary Examiner* — Gabriel Klein
(74) *Attorney, Agent, or Firm* — Joseph M. Butscher; The Small Patent Law Group, LLC

(57) ABSTRACT

Stepped sabots for projectiles are provided. One sabot includes a cylindrical tubular body and at least one stepped surface within the cylindrical tubular body. The stepped surface is configured for engaging at least one complementary surface on a projectile and the stepped surface forms a progressively narrower inner diameter of the cylindrical tubular body.

12 Claims, 6 Drawing Sheets

STEPPED SABOTS FOR PROJECTILES

CROSS-REFERENCE TO RELATED APPLICATIONS

This application claims priority to and the benefit of the filing date of U.S. Provisional Application No. 61/846,482, filed on Jul. 15, 2013, entitled "Sabots for Projectiles," which is hereby incorporated by reference in its entirety.

BACKGROUND

The present disclosure relates generally to sabots for projectiles, such as sabots for hypervelocity projectiles.

Sabots are devices that may be used when firing a projectile, such as when the projectile is smaller than the diameter of the bore from which the projectile is shot or launched, to maintain a position of the projectile within the bore. Some conventional sabot designs use high performance materials (e.g. titanium metal matrix composite). However, these designs interface with the projectile in a manner that is not efficient for these materials. Therefore, these designs have additional mass to handle the inefficiencies of the load path. Also, conventional sabots typically are formed of multiple 'pedals' that increase the cost of manufacturing and assembly and decrease buckling stability.

Additionally, because existing sabots are completed using composite or metallic designs, due to the length of a projectile, the existing designs of sabots fill the gun bore from the pusher plate (or miniature) to near the nose of the projectile. As a result, materials must be used that can withstand the mass thereof, which include, for example, high grade metals or composite materials. These materials are rigid in nature and provide no cushion for the projectile during the launch event. Thus, conventional sabots are designed with thin inserts to provide low wear surface for the gun bore. The cost to produce these sabots is high due to the composite process or the cost of machining complex designs. Also, due to the length of the sabots and general volume the sabots are filling, the weight of the sabot can increase very quickly based on the caliber of the gun bore.

SUMMARY

In accordance with an embodiment, a sabot is provided that includes a cylindrical tubular body and at least one stepped surface within the cylindrical tubular body. The stepped surface is configured for engaging at least one complementary surface on a projectile and the stepped surface forms a progressively narrower inner diameter of the cylindrical tubular body.

In accordance with another embodiment, a sabot is provided that includes a cylindrical tubular body having a varying thickness along an axial length thereof, wherein the varying thickness distributes a stress substantially evenly along the axial length of the cylindrical tubular body. The sabot also includes at least one stepped surface within the cylindrical tubular body, wherein the stepped surface is configured for engaging at least one complementary surface on a projectile. The stepped surface also forms a progressively narrower inner diameter of the cylindrical tubular body.

In accordance with another embodiment, a projectile is provided that includes a cylindrical body and at least one interface region on an outer surface of the cylindrical body. The interface region is defined by a circumferentially extending shoulder region and is configured for engaging at least one stepped surface in an interior of a sabot. The circumferentially extending shoulder region also forms a progressively narrower diameter of the cylindrical body.

DETAILED DESCRIPTION

Figure 1:
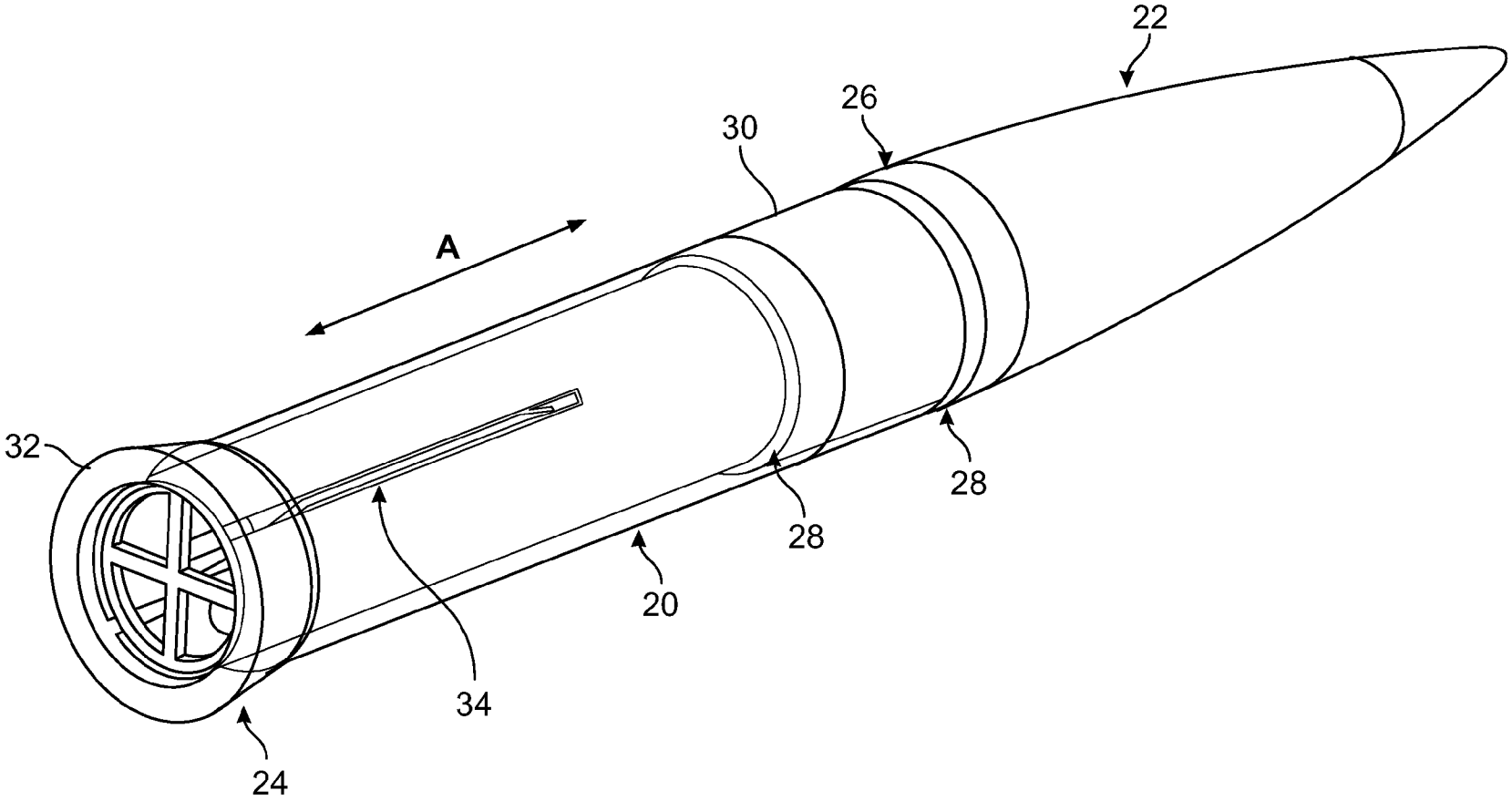
FIG. 1 is an illustration of a sabot in accordance with an embodiment engaged with a projectile.

The following detailed description of certain embodiments will be better understood when read in conjunction with the appended drawings. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments provide one or more sabots, such as for use with projectiles, including hypervelocity projectiles. Some embodiments provide a stepped sabot that imparts the launch loading on the projectile (which may be referred to as an axial sabot) and that may interface with another second sabot that centers the projectile in the bore (which may be referred to as a multi-piece sabot, multiple piece sabot, or lateral sabot). By practicing at least one embodiment, a lighter aft end of the projectile is provided that moves the center of gravity of the projectile forward, resulting in better flight control. By practicing at least one embodiment, the parasitic mass of the launch package is reduced, thereby improving the payload capability of the launched vehicle or reducing the requirements on the launch platform (reducing cost). Also, one or more embodiments simplify the interface between the sabot and projectile and the sabot shape, which may reduce the cost per unit built. Additionally, increased buckling stability is provided, such as by using a single cylinder. Additionally, weight savings (which allows for more payload or less cost per shot) and cost savings (moldable design versus machined design) may be provided.

In particular, various embodiments provide a stepped sabot 20 as shown in FIG. 1. As used herein, the term "sabot" in various embodiments refers to any structure or device that is used with a projectile aligned within a gun (e.g., a canon), such as to fill the space between the outer circumference of the projectile and the inner circumference of the gun, and/or to impart launch loading onto the projectile. For example, different stepped sabots 20 may be provided for use with different caliber projectiles to be launched from within the same cannon, such as to accommodate for different outer dimensions (e.g., outer circumference) of the projectile. The stepped sabot 20 in various embodiments surrounds a portion of a projectile 22 along an axial direction (A) of the length of the projectile 22. For example, in the illustrated embodiment, the stepped sabot 20 extends from a base 24 to a stepped interface of the projectile 22.

It should be noted that in various embodiments, the stepped sabot 20 is configured to receive therein the projectile 22 for placement and subsequent deployment from a cannon or other firing mechanism. The stepped sabot 20 may include various features as described in more detail herein that facilitate engagement with other components (such as a lateral sabot). Thus, in some embodiments, different sabots or sabot parts may be provided with the stepped sabot 20 being the axial sabot that transmits the launch acceleration into the projectile body and optionally a multi-piece or lateral sabot (not shown) to support the balloting of the projectile 22 during launch. In operation, the stepped sabot 20 also supports large compressive loads during the launch. It should be noted that any of the sabots (e.g., the stepped sabot 20 or optional multi-piece or lateral sabot) are discarded (e.g., separated from the projectile 22) upon exit from the gun bore (not shown).

The stepped sabot 20 includes one or more steps or stepped surfaces as described in more detail herein to engage elements of the outer diameter of the projectile 22 (instead of using, for example, a traction ring). Thus, in various embodiments, the inner surface or diameter of the stepped sabot 20 includes a plurality of incremental steps that engage with corresponding elements of the projectile 22 to maintain the projectile 22 with the stepped sabot 20 when inserted therein. Thus, the steps define a changing inner diameter of the stepped sabot 20 that correspond to a changing outer diameter of the projectile 22 with each step defining an interface region or portion for engaging the projectile 22. The stepped sabot 20 includes the internal steps for engagement with the projectile 22, while having an outer diameter complementary to the inner diameter of the gun bore (e.g., sized to be received within the gun bore).

With respect to the illustrated embodiment, two steps 28 are provided (e.g., two lateral steps). However, as should be appreciated, additional or fewer steps 28 may be provided as desired or needed. Moreover, the positioning of the steps 28 within or along the stepped sabot 20 and the spacing between the steps 28 of the stepped sabot 20 may be varied, such as based on the size (or caliber) of the projectile 22, the particular application, etc. Additionally, the steps 28 may be lateral or perpendicular to the longitudinal axis or may be angled in some embodiments.

The stepped sabot 20 generally includes a cylindrical body 30 (e.g., a cylindrical tubular body) that extends along the axial length of the projectile 22. In the illustrated embodiment, the cylindrical body 30 includes a flared end 32 at the base of the stepped sabot 20 (e.g., flared or curved outward), which is shown positioned at the base 24 of the projectile 22. The flared end 32 in some embodiments is configured to engage the propulsion mechanism of the gun, for example, the pusher plate of the gun and may also be used for introducing aerodynamic drag for aft separation from the projectile 22. It should be noted that the configuration and amount of flaring of the flared end 32 may be varied. Also, in some embodiments, a flared end 32 is not provided. The flared end 32 in various embodiments also distributes the load as the pusher plate of the gun may be formed form a lower strength material. However, in some embodiments, a hybrid design may be provided. For example, part of the load of the projectile 22 may be introduced through the base 24 of the projectile 22 (where the pusher plate pushes against the stepped sabot 20 and the base 24 of the projectile 22) and part of the load of the projectile 22 may be introduced to the stepped surfaces of the projectile 22 via the stepped sabot 20.

It should be noted that variations are contemplated. For example, a flared front end or scoop on the front end of the stepped sabot 20 may be optionally or additionally provided. In this embodiment, the aerodynamic drag on the flared or scooped front end pushes the stepped sabot 20 off of the aft end of the projectile 22 after exiting the gun.

It also should be noted that the projectile 22 with stepped sabot 20 may be launched or fired from different types of guns. For example, a rail-gun type of system may be used to fire the projectile 22 and stepped sabot 20, such as described in U.S. Pat. No. 7,526,988, which is incorporated by reference herein in its entirety. For example, the rail-gun system described in FIGS. 1 and 2 of U.S. Pat. No. 7,526,988 may be used.

As should be appreciated, as the number of steps 28 of the stepped sabot 20 is increased, the diameter of the projectile 22 can be made narrower towards the base 24 of the projectile 22. Accordingly, in the illustrated embodiment, the inner diameter of the stepped sabot 20 decreases from the head 26 to the base 24 of the projectile 22. The size of the steps 28 may be varied and the different steps 28 may have the same or different step size (e.g., change in inner diameter). Thus, because of the decreasing inner diameter of the stepped sabot 20 with the projectile 22 being narrower towards the base 24, a center of gravity for the projectile 22 is moved further away from the base 24, thereby improving flight stability of the projectile 22.

In various embodiments, the stepped sabot 20 may be formed from any suitable material, such as based on the gun from which the stepped sabot 20 is to be fired or the projectile 22 to be inserted therein. In some embodiments, the stepped sabot 20 is constructed of an anisotropic material, such as an anisotropic metal material. However, it should be noted that different materials may be used. For example, in some embodiments the stepped sabot 20 may be constructed from a high specific strength material such as a metal matrix composite, polymer matrix composite, or structural ceramic. Examples of metal matrix materials include titanium matrix/silicon carbide fiber and aluminum matrix/boron fiber systems, among others. Examples of polymer matrix composites include composites containing carbon fibers (CFRP) and a combination of carbon and boron fibers (HyBor), among others. Examples of structural ceramics include alumina and silicon carbide, among others. It should be noted that other high specific strength materials can also be used and are contemplated by the various embodiments. It also should be noted that in various embodiments, the stepped sabot 20 is foiined from the same material along the entire length thereof.

In the illustrated embodiment, the stepped sabot 20 engages the projectile 22 at about the middle of the projectile 22 and axially therefrom to the base 24 of the projectile. Thus, for example, a first step 28 at the middle of the projectile may be provided such that the stepped sabot 20 extends from about midway of the projectile 22 to the base 24 of the projectile 22. However, the stepped sabot 20 may be sized and configured differently to engage the projectile 22 at different portions and along more or less of the projectile 22. Thus, the stepped sabot 20 may be positioned at different locations along the projectile 22 and which may not extend to the base 24 or extend beyond the base 24 of the projectile 22 in some embodiments. For example, in various embodiments, the stepped sabot 20 extends beyond the aft end of the projectile 22 to prevent an unintentional load path from being formed (e.g., prevent the projectile from contacting a push plate of the gun during firing or launch).

In operation, when thrust is applied to an aft surface of the stepped sabot 20 (e.g., at the flared end 32), the stepped sabot 20 applies a force in the forward direction to the projectile 22 where the stepped sabot 20 couples to or engages the projectile 22. In various embodiments, the stepped sabot 20 couples to the projectile 22 at each of the steps 28 that define engagement interfaces or interface regions. Thus, the configuration of the stepped sabot 20 defines engagement or connection points for engaging with the projectile 22 at each of the steps 28 (rather than ridged or toothed regions), which also reduces the outer diameter of the projectile 22 within the stepped sabot 20. It should be noted that the projectile 22 may include other components, such as fins 34 that are shown in a retracted state within the stepped sabot 20. When the stepped sabot 20 disengages from the projectile 22 after being launched from the gun, the fins 34 extend outward from the projectile 22 and are subsequently controlled as needed during the flight of the projectile 22.

With respect to various embodiments of the stepped sabot 20, different high performance materials may be provided, as well as different interface designs to reduce the parasitic mass of the sabot. For example, various embodiments combine the design of the projectile structure, sabot interface of the stepped sabot 20 and ideal loading characteristics of the stepped sabot 20 into a solution that reduces the mass used to complete a successful launch of the projectile 22. In various embodiments, the sabot material can be fully loaded in only one direction and the material selected is significantly stronger in that orientation than in any other.

Thus, in various embodiments, the stepped sabot 20 includes a least one stepped surface defined by the one or more steps 28. The stepped surface(s) in the illustrated embodiment form a generally cylindrical body for engaging at least one complementary surface on the projectile 22. In some embodiments, each of the stepped surfaces forms a progressively narrower cylinder (e.g., progressively smaller inner diameter) as the stepped sabot 20 progresses towards a base 24 of the projectile 22 such that a center of gravity of the projectile 22 is moved forward. The stepped sabot 20 includes a cylindrical portion or body 30 with internal steps for engaging the projectile 22. In some embodiments, a lighter sabot may be provided. In some embodiments, a plurality of stepped surfaces are provided with at least one of the steps 28 located closer to a forward end of the cylindrical body 30 than an aft end of the cylindrical body 30.

Figure 2:
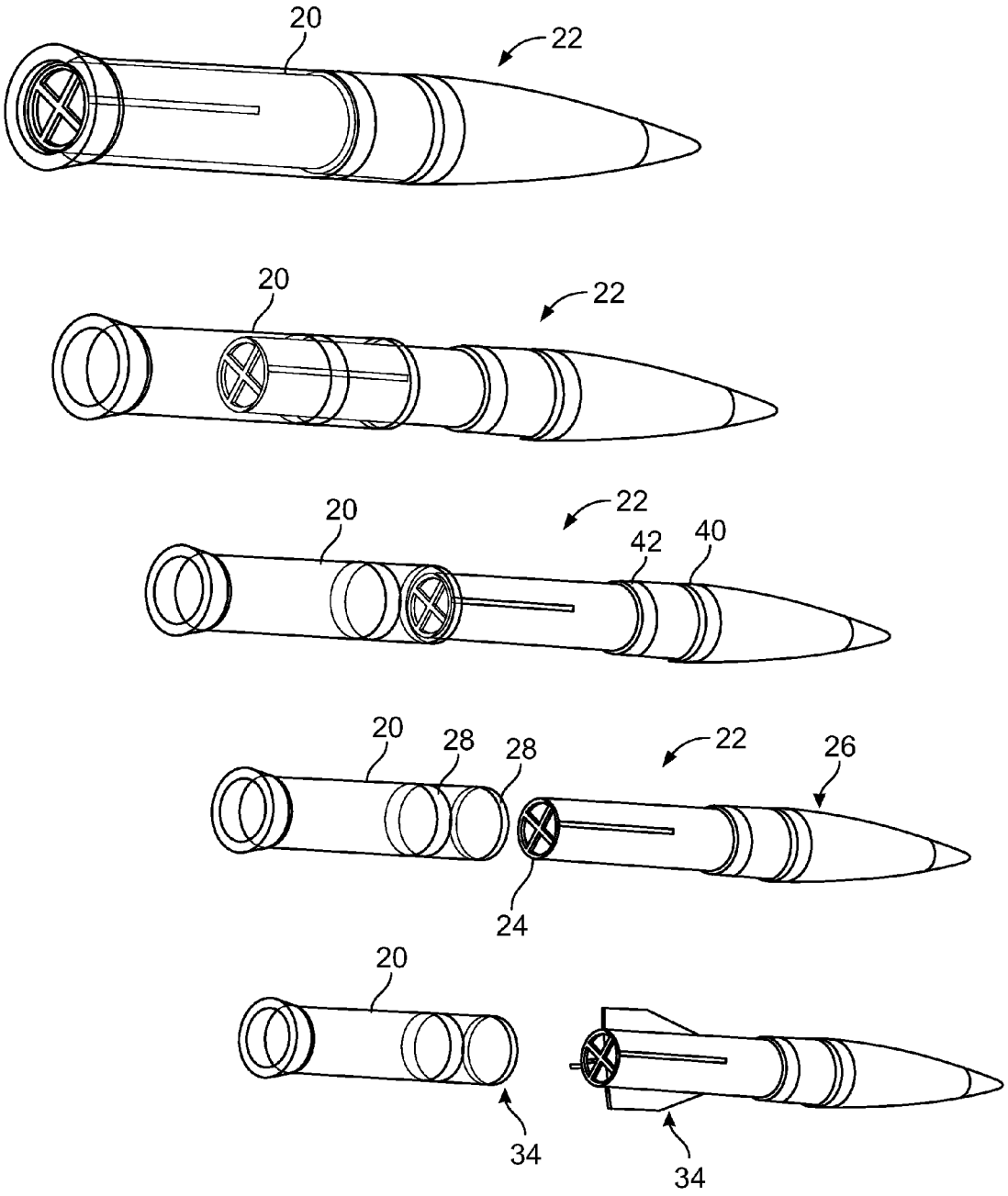
FIG. 2 is an illustration of the projectile separating from the sabot of FIG. 1.

FIG. 2 illustrates the progression of the disengagement of the stepped sabot 20 from the projectile 22 during a launch or firing thereof. As can be seen, as the projectile 22 with the stepped sabot 20 is launched, the projectile 22 is propelled from within the stepped sabot 20 as viewed from top to bottom of FIG. 2. For example, as can be seen, the stepped sabot 20 slides aft to separate from the projectile 22. Once the projectile 22 is fully expelled from the stepped sabot 20, the fins 34 extend outward, such as based on a biasing force that causes the extension of the fins 34.

As can be more clearly seen in FIG. 2, the projectile has an incrementally decreasing outer diameter complementary to the steps 28 of the stepped sabot 20. In particular, the projectile 22 includes interface regions 40 and 42 defined by circumferentially extending shoulder regions that are configured to engage the steps 28 of the stepped sabot 20. For example, the interface regions 40 and 42 define planar rims that abut and engage complementary planar surfaces defined by the steps 28 of the stepped sabot 20. Thus, the steps 28 within the stepped sabot 20 are configured (e.g., sized and shaped) to abuttingly engage the interface regions 40 and 42 of the projectile 22 during lunch to maintain the axial position of the projectile 22 within the stepped sabot 20. For example, at least one of the interface regions 40 and 42 rest against the steps 28 when the projectile 22 is inserted within the stepped sabot 20 and prevents the projectile 22 from moving aft within the stepped sabot 20. Thus, the projectile 22 includes different regions having different diameters as a result of the interface regions 40 and 42, which in this embodiment defines a projectile 22 that is narrower at the base 24 than at the head 26. The interface regions 40 and 42 generally define complementary steps to the steps 28 of the stepped sabot 20. The step size of the interface regions 40 and 42, thus, defines an amount of decrease in the diameter of the projectile 22 heading to the aft thereof.

It should be noted that the interface regions 40 and 42 may be designed or positioned, for example, based on a load at each position along the projectile 22. For example, based on firing or loading requirements, the interface regions 40 and 42 may be positioned at different locations along the projectile 22. Additionally, the number of interface regions 40 and 42, and corresponding steps 28, likewise may be defined based on load requirements. In the illustrated embodiment, the interface region 40 is positioned in proximity to and just aft of the head 26 (e.g., tungsten impact portion), which may be a defined distance therefrom (e.g., a percentage of the size of the head 26).

Additionally, the steps 28 may be located based on other considerations or requirements. For example, the interface region 42 and corresponding step 28 may be positioned just aft of a thruster (not shown) to avoid a load on the thruster. As should be appreciated, during launch of the projectile 22, portions forward of the steps 28 are compressed and portions aft of the steps 28 are stretched.

Figure 3:
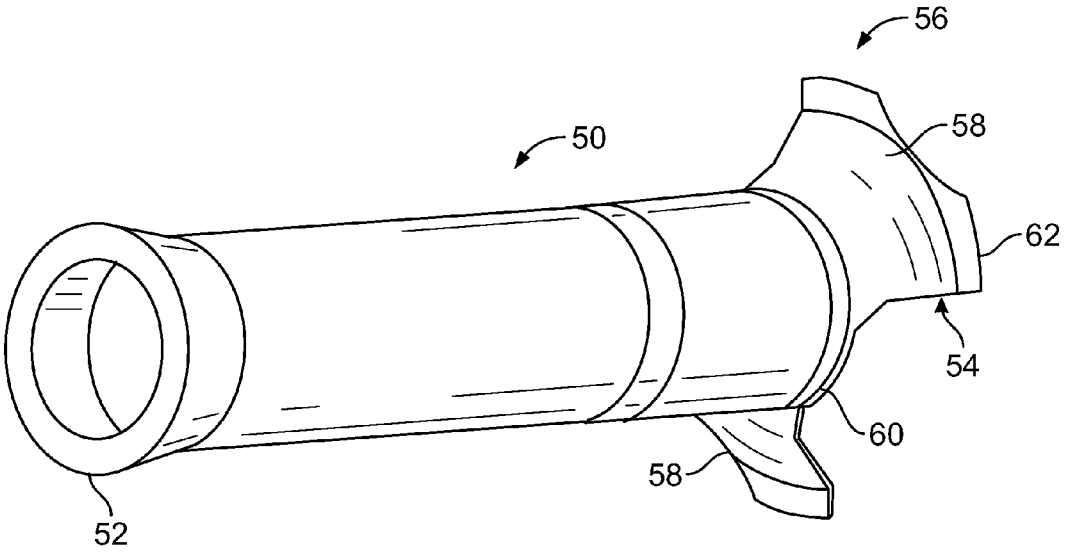
FIG. 3 is an illustration of a sabot in accordance with another embodiment.

Variations and modifications are contemplated. For example, as shown in FIG. 3, a stepped sabot 50 may be provided. The stepped sabot 50 is similar to the stepped sabot 20 having a generally cylindrical body and a flared end 52. However, in this embodiment, the stepped sabot 50 includes an interface region 54 at a front end 56 thereof. For example, the interface region 54 may form a flared front end or scoop on the front end of the stepped sabot 20 that may be optionally or additionally provided. In this embodiment, the flared or scooped front end pushes the stepped sabot 50 off of the aft end of the projectile 22. The interface region 54 defines complementary surfaces for engaging another sabot. Additionally, the interface region 54 is configured to define an aerodynamic feature in some embodiments, such as to drive the stepped sabot 50 to separate from the projectile 22 (shown in FIGS. 1 and 2).

In the illustrated embodiment, the interface region 54 is defined by flange segments 58 having a spacing therebetween on each side. For example, the flange segments 58 are oppositely positioned at the front or forward end 56 of the stepped sabot 50 and extend about or circumferentially approximately 45 degrees along an edge 60 of the forward end 56. However, the flange segments 58 may extend along more or less of the edge 60. The flange segments 58 generally have a concave profile with a lip 62 at an end thereof that forms a planar surface generally perpendicular to the longitudinal axis of the body of the stepped sabot 50.

However, as should be appreciated, the size, shape and configuration of the interface region 54 may be varied as desired or needed, for example, based on aerodynamic requirements or the configuration of a another sabot to be engaged therewith. For example, the interface region 54 may be sized and shaped to receive and engage another sabot as known in the art. Thus, the interface region 54 may define a sabot interface proximate a forward end of the cylindrical body 30 to engage, for example, a different and separate sabot.

Figure 4:
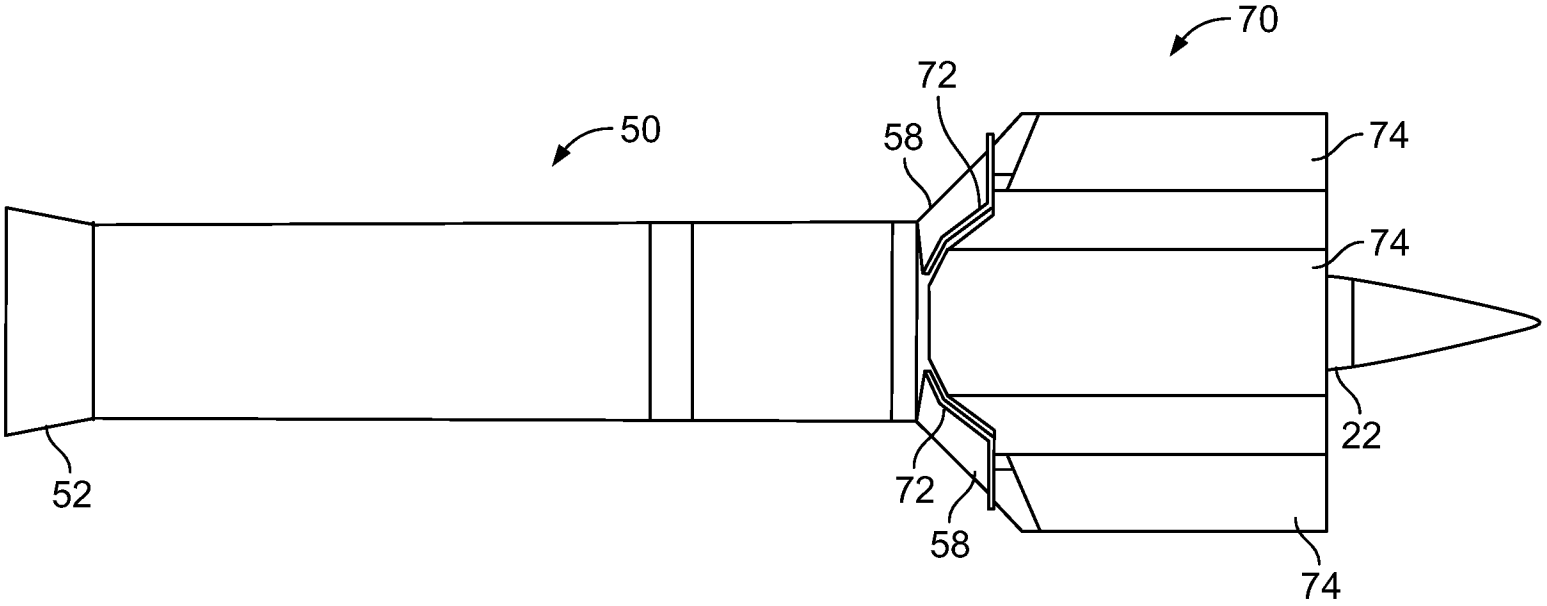
FIG. 4 is an illustration of a sabot in accordance with various embodiments engaged with a multi-piece sabot.

In one embodiment, the interface region 54 is configured to engage a multi-piece sabot 70 as shown in FIG. 4 (which also may be referred to as a lateral sabot). The multi-piece sabot 70 has complementary engagement regions 72 to abut the surfaces of the interface region 54. In this embodiment, the multi-piece sabot 70 is a multi-piece design (e.g., three or four piece design) formed from a plurality of segments 74 that extend around the projectile 22 forward of the stepped sabot 50. In general, the multi-piece sabot 70 is also configured aerodynamically to disengage from the projectile 22 when launched.

Thus, in various embodiments, a stepped sabot is provided with a simplified interface, such that the sabot is primarily loaded in compression. In some embodiments, the material for the sabot is selected to have a high capability in compression, thereby reducing the total mass. The various steps, for example, the steps 28, may be sized or positioned based on different load, stress, flight and/or launch requirements. For example, to maintain the volume of the projectile 22 aft for the fins 34, the steps 28 may be sized to provide corresponding diameters of the various portions of the projectile 22 to satisfy the load requirements.

Figure 5:
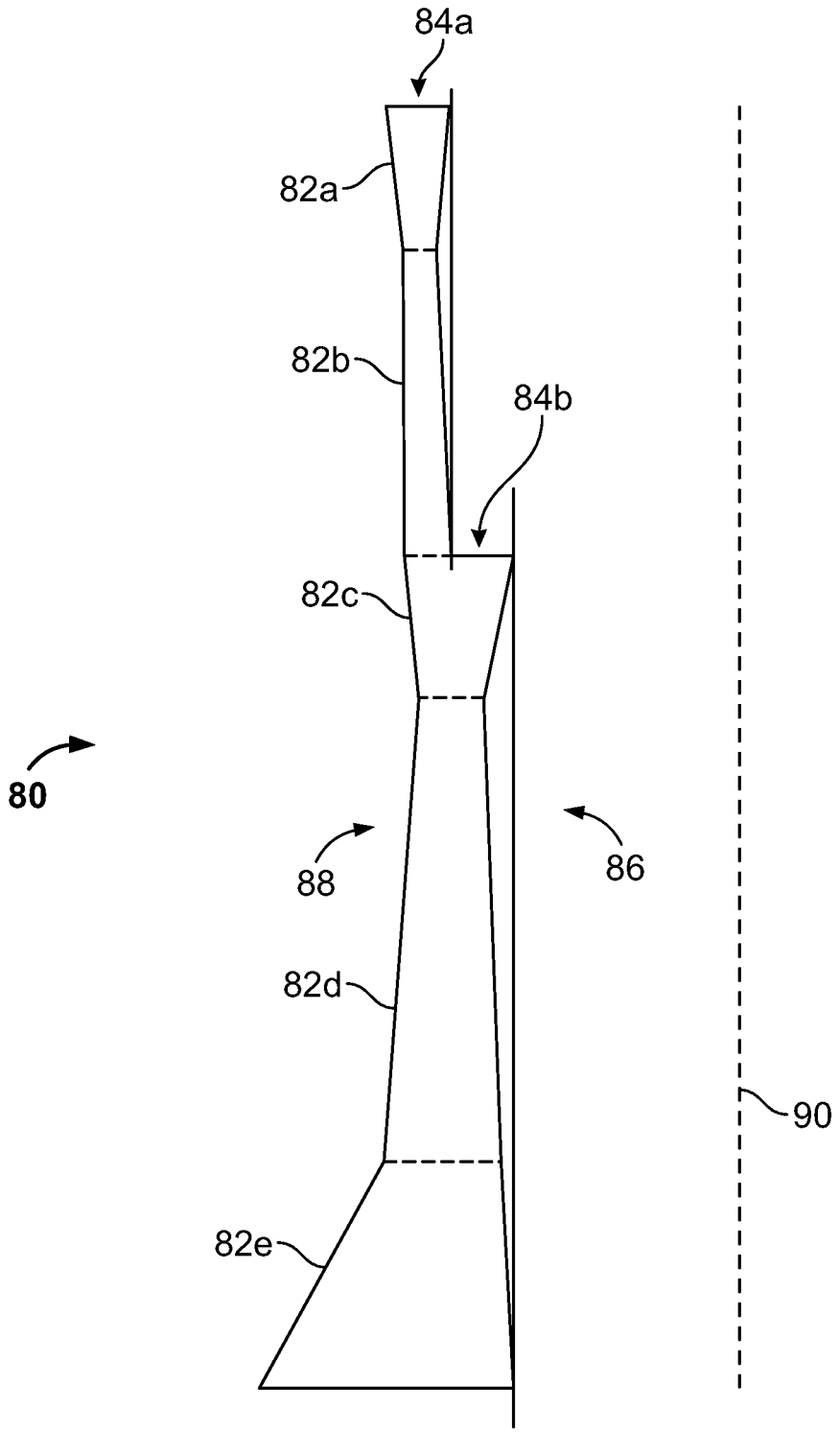
FIG. 5 is a diagrammatic illustration of a profile of a sabot in accordance with an embodiment.

For example, FIG. 5 is a diagrammatic representation 80 of a stepped sabot illustrating the sizing of the sabot. FIG. 5 illustrates one side of the sabot. In various embodiments, in addition to the multiple steps, the sabot is variably sized in diameter to spread the load or stresses on the sabot, such as to either approximately even the stress at each of a plurality of sections 82 of the sabot (five sections 82 are illustrated in FIG. 5, but more or less may be provided) or to decrease the stress at an interface. It should be noted that the sections 82 are not physically separate sections, but are merely used for illustration to generally show different regions may have the same load or stress. Thus, in various embodiments, the sabot is forming as a single unitary construction. In the illustrated embodiments, two step interfaces 82 are provided, with one at a front section 82*a* and one between second and third sections 82*b*, 82*c*. As can be seen in the illustrated embodiment, the thickness of the profile of the sabot decreases along the entire first section 82*a* (along both the inner and outer diameter) and then increases along the entire second section 82*b* (along both the inner and outer diameter) to have a same diameter at the start of the first section 82*a* as at the end of the second section 82*b*. Thus, angled walls are thereby formed.

The diameter of the third section 82*c* is increased in a stepwise manner to form the step interface 84*b* and the profile of the third section decreases along an entirety of a length thereof (along both the inner and outer diameter). It should be noted that in various embodiments, the sections 82*a*, 82*c* and 82*e* may have thicknesses that are increased to reduce the stress to a level that is compatible with a lower strength interfacing material and in the sections 82*b* and 82*d* the thicknesses are increased progressing aft because of the increasing load. It should be noted that profile at the interfaces may be blended in some embodiments.

In the fourth section 82*d*, the thickness of the profile of the sabot increases along the entirety thereof. The fifth section 82*e* is similarly sloped. However, the angle of the slope is increased along both the inner and outer surfaces 86, 88 relative to the fourth section 82*d*.

It should be appreciated that the slopes, relative slopes and lengths of the sections 82 may be varied as desired or needed. Additionally, additional or fewer sections 82 may be provided. For example, a varying thickness may be defined by at least one of sloped inner or outer walls of the cylindrical body 30 (shown in FIGS. 1 and 2). In some embodiments, the varying thickness is defined by sloped inner and outer walls of the cylindrical body 30 and along at least a portion of the cylindrical tubular body, a degree of slope is different along corresponding areas of the inner and outer walls. It also should be noted that the dashed line 90 represents the centerline of the sabot.

In general, moving aft along the sabot, each section 82 has increasing load because each section 82 is pushing more mass. Thus, in some embodiments, the thickness of the sections 82*b* and 82*d* increased in the aft direction to satisfy sabot material limits. In addition, the sabot interfaces with components (such as the lateral or multi-piece sabot, projectile, and pusher plate) with generally lower strength materials. Thus, in some embodiments, the thicknesses in sections 82*a*, 82*c*, and 82*e* increase near the interfaces to lower the stress.

Figure 6:
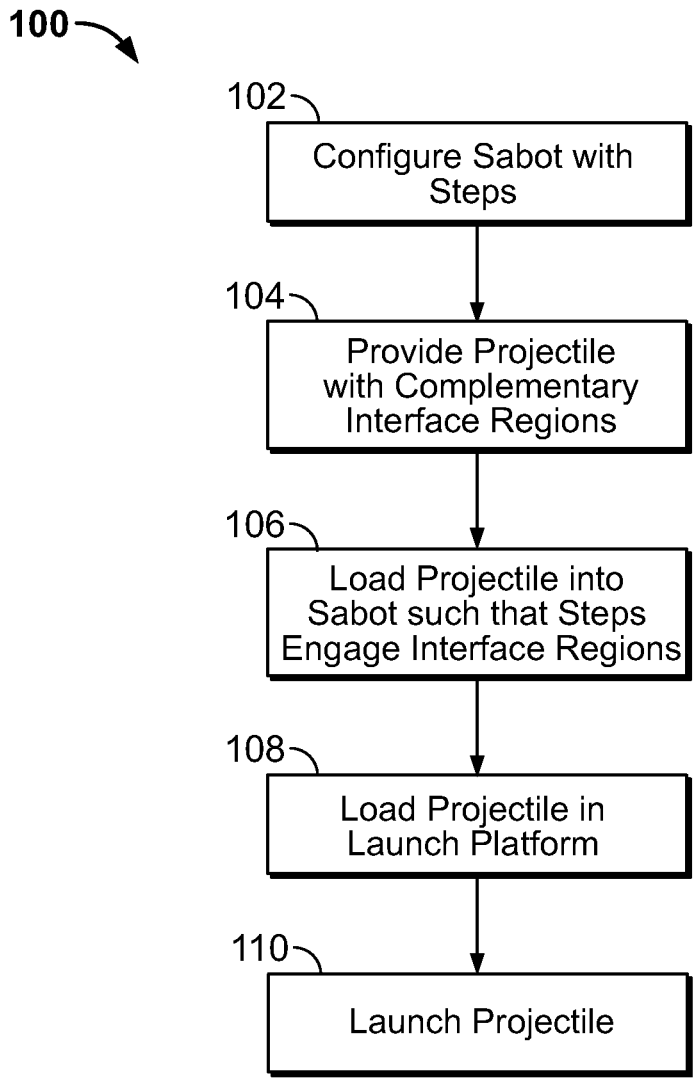
FIG. 6 is an illustration of operations performed by an embodiment to launch a projectile.

In various embodiments, a method 100 as shown in FIG. 6 may be provided for launching a projectile. In some embodiments, the method 100, for example, may employ structures or aspects of various embodiments (e.g., systems and/or methods) discussed herein. In various embodiments, certain steps may be omitted or added, certain steps may be combined, certain steps may be performed simultaneously, certain steps may be perfoiined concurrently, certain steps may be split into multiple steps, certain steps may be performed in a different order, or certain steps or series of steps may be re-performed in an iterative fashion.

The method 100 includes configuring a sabot with one or more steps at 102. For example, the steps may define engagement portions to engage complementary regions of a projectile. In some embodiments, at each step, the inner diameter of the sabot is decreased from a forward end of the sabot to an aft end of the sabot. The method 100 also includes providing a projectile with interface regions at 104. The interface regions may be shoulders portions as described herein that are complementary to the steps of the sabot.

The method 100 further includes loading the projectile into the sabot at 106. As the projectile is loaded into the sabot the complementary steps and interface regions engage each other, for example, in an abutting manner to position the projectile and maintain the projectile within the sabot. For example, the steps prevent axial movement of the projectile within the sabot once engaged with the interface regions.

The projectile with sabot are then loaded in a launching device, such as a launch platform (e.g., cannon or gun) at 108 and launched (e.g., fired) at 110. For example, when thrust is applied to the aft surface of the sabot, the sabot applies a force in the forward direction to the projectile with the sabot coupled to the projectile. Once launched, the sabot separates from the projectile and optional fins may extend from the sabot as described herein.

Thus, various embodiments provide a sabot having one or more stepped surface(s) to engage portions of a projectile. The sabot may be used with different types and sizes of projectiles. For example, the sabot may be used to support a restricted length lateral sabot allowing the use of glass-reinforced moldable polyamide materials.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from the scope thereof. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A munition comprising:

a projectile; and a sabot including a single monolithic cylindrical tubular body having a tube forward end and a tube aft end, a first stepped surface within the cylindrical tubular body proximate to the tube forward end, and a second stepped surface within the cylindrical tubular body closer to the tube aft end than the first stepped surface, wherein the first stepped surface has a first cylindrical inner diameter, and wherein the second stepped surface has a second cylindrical inner diameter that is smaller than the first cylindrical inner diameter, the first and second stepped surfaces forming a progressively narrower inner diameter of the cylindrical tubular body, wherein an outer surface of the tube aft end of the cylindrical tubular body comprises an outwardly flared portion, wherein the cylindrical tubular body has a length configured to extend beyond a base of the projectile when the projectile is received within the cylindrical tubular body, wherein the first cylindrical inner diameter and the second cylindrical inner diameter are complementary to respective first and second outer diameters of the projectile, wherein the projectile is configured to outwardly propel from the tube forward end.

2. The sabot of claim 1, wherein the cylindrical tubular body has a varying thickness to define a varying diameter.

3. The sabot of claim 2, wherein the thickness varies differently along an inner surface of the cylindrical tubular body and an outer surface of the cylindrical tubular body.

4. The sabot of claim 1, wherein the cylindrical tubular body comprises a scooped front end.

5. The sabot of claim 1, wherein the first and second stepped surfaces are positioned along the cylindrical tubular body such that a center of gravity of the projectile is moved forward.

6. The sabot of claim 1, wherein the cylindrical tubular body comprises a sabot interface proximate the tube forward end of the cylindrical tubular body configured to engage a different and separate sabot.

7. The sabot of claim 1, wherein the cylindrical tubular body is formed from an anisotropic material.

8. The munition of claim 1, wherein the first stepped surface is spaced apart from the second stepped surface.

9. The sabot of claim 1, wherein the outwardly flared portion has a diameter that exceeds a diameter of a remainder of the sabot.

10. A munition comprising:

a projectile; and a sabot including a single monolithic cylindrical tubular body having a tube forward end and a tube aft end, a first stepped surface within the cylindrical tubular body proximate to the tube forward end, and a second stepped surface within the cylindrical tubular body closer to the tube aft end than the first stepped surface, wherein the first stepped surface has a first cylindrical inner diameter, and wherein the second stepped surface has a second cylindrical inner diameter that is smaller than the first cylindrical inner diameter, wherein the first cylindrical inner diameter and the second cylindrical inner diameter are complementary to respective first and second outer diameters of the projectile, wherein an outer surface of the tube aft end of the cylindrical tubular body comprises an outwardly flared portion, wherein the projectile is configured to outwardly propel from the tube forward end.

11. The munition of claim 10, wherein the first stepped surface is spaced apart from the second stepped surface.

12. The munition of claim 10, wherein the outwardly flared portion has a diameter that exceeds a diameter of a remainder of the sabot.

* * * * *